United States Patent [19]

Kleeb

[11] 4,112,277

[45] Sep. 5, 1978

[54] PUSH-BUTTON SWITCH UNITS

[75] Inventor: Markus Kleeb, Reinach, Switzerland

[73] Assignee: Tschudin & Heid AG, Switzerland

[21] Appl. No.: 717,691

[22] Filed: Aug. 25, 1976

[30] Foreign Application Priority Data

Aug. 29, 1975 [CH] Switzerland ..... 11235/75

[51] Int. Cl.[2] ..... H01H 3/14

[52] U.S. Cl. ..... 200/153 J; 200/159 R; 200/291; 200/322; 200/328

[58] Field of Search ..... 200/153 J, 159, 291, 200/321, 322, 328

[56] References Cited

U.S. PATENT DOCUMENTS

| | | | |
|---|---|---|---|
| 2,956,446 | 10/1960 | Ensign, Jr. et al. | 200/153 J X |
| 3,229,548 | 1/1966 | De Rougemont et al. | 200/153 J X |
| 3,582,592 | 6/1971 | Schadow | 200/153 J |
| 3,697,713 | 10/1972 | Ohkita | 200/153 J |
| 3,914,570 | 10/1975 | Lockard | 200/153 J |

FOREIGN PATENT DOCUMENTS

| | | | |
|---|---|---|---|
| 2,248,600 | 5/1975 | France | 200/153 J |

*Primary Examiner*—Harold J. Tudor
*Attorney, Agent, or Firm*—McGlew and Tuttle

[57] ABSTRACT

A press-button unit has a push-rod mounted to be axially displaceable in a sleeve. An external surface portion of the push rod is provided with a groove system, with a recess and with a rib member. The rib member extends between a leading portion of the groove system and a leading portion of the recess. The press-button unit is provided with a latching element, which is accessible through an opening in the sleeve and which is capable of co-operating with the groove system to cause the press-button unit to have a latching action. The latching element is selectably positionable relative to the rib member, without even partial disassembly of the unit, to cause a portion of the latching element to enter either the groove system or the recess so that — in dependence on the selected setting of the latching element — the press-button unit is selectively operable either with or without latching action.

5 Claims, 4 Drawing Figures

PUSH-BUTTON SWITCH UNITS

BACKGROUND OF THE INVENTION

The present invention relates to a push-button unit for a switch.

A known push-button switch unit is provided with a push-rod for actuating the electrical contact means of the switch. The push rod may be pushed in to displace the rod from an inoperative first position into a switch actuating position. Most known push-button switch units are constructed either as latching or as non-latching switches. In the first case, the push-rod, after being pushed in, is latchably retained in the switch-actuating position until it is again released by a renewed pressure. The push-rod can, for the attainment of this mode of operation, be provided with a guide groove, which forms a closed path cam and into which a latching element extends. In the second case, i.e. when the switch is constructed as non-latching switch, the guide groove and the latching element are absent so that the push-rod after being released always returns immediately from the switch-actuating position into the inoperative position.

With these previously known push-button switch units, a particular switch unit can thus in accordance with its construction be used either only as a latching switch or as a non-latching switch. Installation and switchboard construction firms thus must have available in their stores switches of both the aforementioned kinds. This represents a considerable disadvantage especially for smaller firms since the requirement at any time for such switch units of either of the aforementioned kinds may be subject to very strong fluctuations. Since the switch units can of course also still be equipped with different numbers of closing, opening and changeover contacts, such firms often find it necessary to maintain a relatively large stock of switch units in store.

SUMMARY OF THE INVENTION

According to the present invention, there is provided a push-button unit comprising a sleeve member having a longitudinal axis, a push-rod member mounted to be axially displaceable in the sleeve member between an outer position and an inner position, a guide groove system defined in a surface portion of the push-rod member, a latching element mounted on the sleeve member to extend internally thereof, the guide groove system being engageable by a portion of the latching element - on the push-rod being displaced to the inner position - thereby to latchably retain the push-rod in the inner position and - on renewed pressure being applied to the push-rod - to allow the push-rod to return to the outer position, an opening provided in the sleeve member in the vicinity of the latching element to provide access thereto, a recess defined in the surface portion of the push-rod member, and a rib member defined in the surface portion of the push-rod member and extending between the recess and the guide groove system, the latching element being selectably positionable relative to the rib member to cause the portion of the latching element to enter a selected one of the guide groove system and the recess, thereby to render the push-button selectively operable with latching action.

BRIEF DESCRIPTION OF THE DRAWINGS

An embodiment of the present invention will now be more particularly described by way of example with reference to the accompanying drawings, in which.

DESCRIPTION OF THE PREFERRED EMBODIMENT

Figure 1:
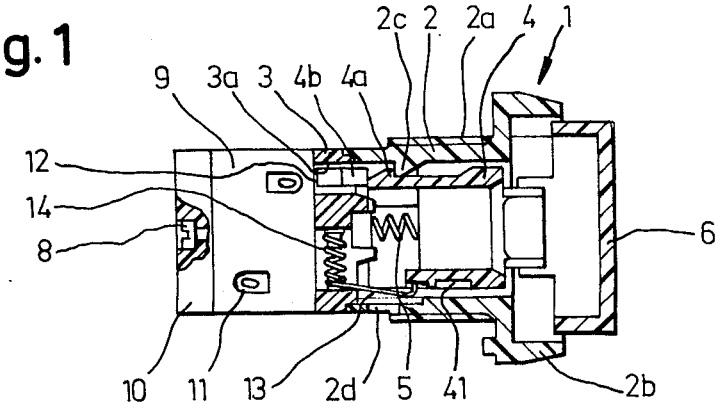
FIG. 1 shows a somewhat simplified longitudinal section through a push-button switch embodying the invention.

Referring now to the accompanying drawings, a push-button switch unit illustrated in FIG. 1 is provided with a housing of synthetic material, designated generally by a reference numeral 1, with a sleeve 2 provided with an end cap 3 welded thereto. The sleeve 2 is provided with an externally threaded portion 2*a* and, at its end remote from the end cap 3, with a tubular portion 2*b* of enlarged diameter and opening outwardly. Furthermore, a push-rod member 4 is arranged in the sleeve 2 and guided to be axially displaceable but not rotatable relative to the sleeve. The push-rod 4 is loaded by two compression springs, of which one is schematically indicated in FIG. 1 and designated by the reference numeral 5, with a force directed towards the enlarged tubular portion 2*b*. The sleeve 2 is provided on the inner side with a lug 2*c* which together with a lug 4*a* of the push-rod 4 forms an abutment. This abutment prevents the springs 5 from pressing the push-rod 4 out of the sleeve 2 and defines an outer or first position of the push-rod. A push-button 6 is inserted into a socket on the free end of the push-rod. Two not illustrated contacts, which together form a switching element, are further accommodated in the sleeve 2. The push-rod 4 can, by pressing it inwardly of the sleeve 2, be brought from the rest position into an inner or second position, in which it actuates the switch means, i.e. moves the movable contact elements thereof from one setting into the other. A lamp serving for the indication of the setting can be accommodated in the interior of the push-rod 4. Switch means 9, containing two switch contact elements and illustrated schematically in FIG. 1, and a closure plate 10 are fastened by means of screws 8 to the end cap 3. Soldering tags 11 serve for the connection of the switch contacts. The end cap 3 is provided with an opening 3*a*. Into the opening 3*a* extends a projecting portion 4*b* of the push-rod 4 and a coupling pin 12, which is displaceably relative to the switch means 9 and which co-operates with movable contact elements of the switch means 9, so that these are likewise actuable by the push-rod 4. The switch means 9 is constructed in such a manner that further switch means can, according to need, be fastened and coupled by the pin 12 with the push-rod 4.

Figure 2:
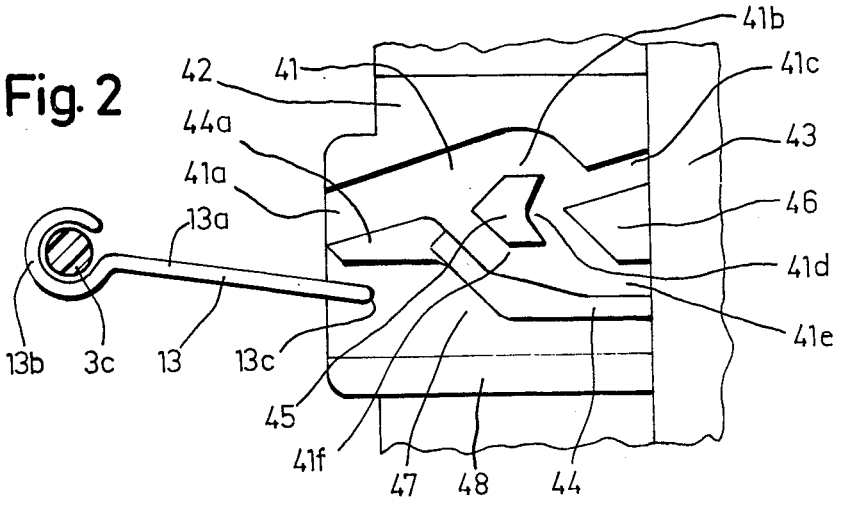
FIG. 2 shows a plan view of a sleeve and a latching element to an enlarged scale, wherein the latching element is disposed in such a position that the push-button switch operates in a non-latching mode.
Figure 3:
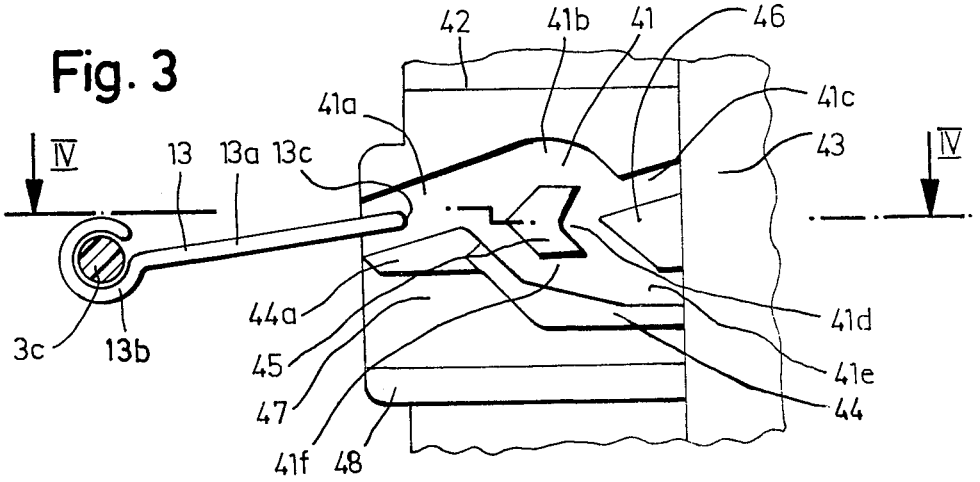
FIG. 3 shows a view corresponding to that shown in FIG. 2 except the latching element is disposed in such a position that the push-button switch operates in a latching mode.
Figure 4:
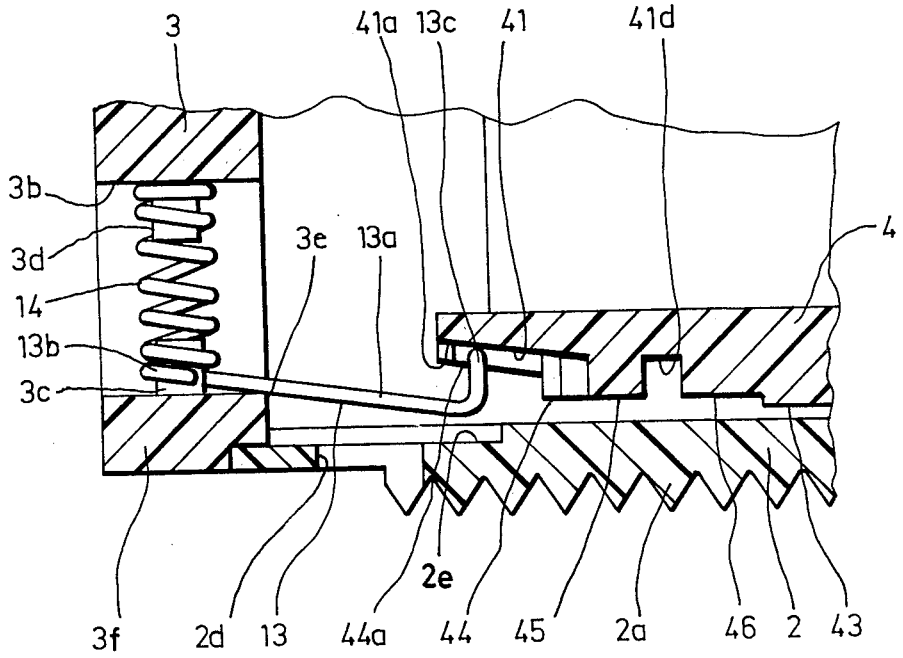
FIG. 4 shows a section along the line IV—IV in the FIG. 3.

The push-rod 4 is provided at its outside with a guide groove system 41, which is evident to an enlarged scale in FIGS. 2, 3 and 4. The different portions of the guide groove system 41 are designated in the drawings by the reference numerals 41*a*, 41*b*, 41*c*, 41*d*, 41*e* and 41*f* and together form a closed path cam. The guide groove system 41 is bounded by a longitudinal rib 42 on the side disposed at top in the FIGS. 2 and 3, by an annular section 43 on the side disposed at the right and by a rib 44 on the lower side. Furthermore, a V-shaped spigot 45 is present, which is surrounded all around by grooves of the guide groove system and the point of which is directed towards the portion 41*a* of the guide groove 41. A projection 46, separating the guide groove portions 41*c* and 41*e*, projects from the annular section 43 of the push-rod 4 towards the spigot 45. The bottom or floor surface of the guide groove portion 41*a* is inclined inwardly towards the leading extremity of the sleeve 2 as can be seen from FIG. 4. That section 44*a* of the rib 44, which bounds this guide groove portion 41*a* on the one side, is inclined in the same direction and has a lesser height than the remaining part of the rib 44. The push-rod 4 is further provided with a recess 47. This is limited on the one side against the guide groove system 41 by the rib 44. On the other side, the recess 47 is bounded by a rib 48. The recess 47 thus likewise forms a groove.

The end cap 3 is provided with a recess or opening 3*b*, which is shown best in FIG. 4. Two cylindrical spigots 3*c* and 3*d*, aligned with one another, extend into this opening 3*b*.

The push-button switch assembly is provided with a latching member 13. This is resiliently deformable and may be of spring steel wire. The latching element 13 has a straight middle portion 13*a*. One end portion of the latching element 13 is bent into a ring 13*b* which encompasses the spigot 3*c*. The other end portion 13*c* of the latching element is so bent that an extreme end portion projects towards the axis of the sleeve 2. A compression spring 14 which urges the ring 13*b* of the latching element 13 against the section 3*f* of the end cap 3, is mounted on the two spigots 3*c* and 3*d*. When the push-rod 4 and the latching element 13 are disposed in the position illustrated in FIG. 4, the end 13*c* of the latching element 13 projects into the guide groove section 41*a* and contacts the bottom or floor surface of the groove. The middle section 13*a* of the latching element is then inclined away from the ring 13*b* somewhat outwardly with respect to the axis of the sleeve 2 and bears on the edge 3*e* of the body 3. The compression spring 14 engaging the latching element 13 thus urges the end 13*c* thereof approximately radially against the push-rod 4.

The sleeve 2 is provided in the region of the latching element 13 with a slot-shaped opening 2*d* as well as with a recess 2*e*. When the push-rod 4 of the push-button switch is disposed in its first or outer position, a pointed tool, such as a small screw-driver, may be inserted through the opening 2*d* and the latching element 13, or more accurately stated the end portion 13*c* thereof, may be raised above the rib 44. The end portion 13*c* of the latching element 13 may thus be displaced from the guide groove 41 into the recess 47 and back again into the guide groove. Since the latching element 13 itself is elastically deformable and is additionally resiliently mounted and since the rib section 44*a* is moreover inclined inwardly towards the leading extremity of the push-rod and lower than the remaining part of the rib 44, the latching element 13 can be moved relatively easily over the rib 44 when the push-rod 4 is disposed in its outer position.

In FIGS. 1 and 2, the latching element is illustrated when in the position it occupies when it projects into the recess 47. When the push-rod 4 is brought from its outer position by pushing it into the sleeve and towards its switch-actuating position, the end 13*c* of the latching element 13 arrives at the rearward end of the recess 47, i.e. into the proximity of the annular push rod section 43. When the push-button 6 is released, the push-rod 4 at once again moves back into its rest position. Thus, when the latching element 13 is so disposed as to enter into the recess 47, the push-button switch is adapted to operate in its non-latching mode.

Now, the latching element 13 is to be brought into the setting illustrated in FIGS. 3 and 4. On pushing-in of the push-rod 4, the latching element end portion 13*c* moves from the guide groove portion 41*a* over the portion 41*b* into the portion 41*c*. When the push-button 6 is now released, the latching element end portion 13*c* moves into the guide groove portion 41*d* and holds fast the push-rod now disposed in the switch-actuating position. On a renewed pressure being applied to the push-rod, the latching element end 13*c* moves into the guide groove portion 41*e*. As soon as the push-button is released, the push-rod again moves back into its outer position, while the latching element end moves back from the guide groove portion 41*e* through the portion 41*f* to the portion 41*a*. When the latching element 13 enters the guide groove system 41, the push-button switch thus operates in a latching mode.

The push-button switch can thus, in accordance with the setting of the latching element, be selectively operated either in a latching or in a non-latching mode. This double applicability makes it possible for the installation and switch-board construction firms incorporating switch assemblies embodying the invention to reduce the number of switch assemblies held in stock. The switch assembly may be mounted on a panel by means of a portion of the sleeve 2, which is provided with the externally threaded portion 2*a*, and which is inserted through a bore hole in such a mounting plate or panel and then secured thereto by means of a nut which engages the threaded portion 2*a*.

The push-button switch can of course be modified in different respects. For example, the recess 47 may be formed as a slot-shaped opening instead of as a groove.

While a specific embodiment of the invention has been shown and described in detail to illustrate the principles of the invention, it will be understood that the invention may be embodied otherwise without departing from such principles.

I claim:

1. A push-button unit comprising, in combination, a sleeve member having a longitudinal axis; a push-rod member mounted to be axially displaceable in said sleeve member between an outer position and an inner position; a guide groove system defined in a surface portion of said push-rod member; a latching element mounted on said sleeve member to extend internally thereof, said guide groove system being engageable by a portion of said latching element, responsive to said push rod being displaced to said inner position, thereby to latchably retain said push-rod in said inner position and, responsive to renewed pressure being applied to said push-rod, to allow said push-rod to return to said outer position; an opening provided in said sleeve member in the vicinity of said latching element to provide access thereto; a recess defined in said surface portion of said push-rod member; and a rib member defined in said surface portion of said push-rod member and extending between said recess and said guide groove system; said push-rod surface portion and the inner surface of said sleeve defining a free intermediate space for lateral displacement of said latching element portion; whereby said latching element is selectable positionable on either side of said rib member, by a tool inserted through said opening, to cause said latching element portion to enter a selected one of said guide groove system and said recess; whereby, in dependence on the selected setting of said latching element said push-button unit is ready for operation selectively with latching action and without latching action without any disassembly of the components of the unit or displacement of any such components except said latching element.

2. A push-button unit as defined in claim 1, in which said rib member comprises a portion having a height less than the depth of said free intermediate space, measured in the same direction.

3. A push-button unit aa defined in claim 2, wherein said guide groove system is provided with a leading end portion into which, responsive to said push-rod member being in said outer position and said latching member being set to operate in said latching mode, said portion of said latching element extends; said leading end portion of said groove system having a floor surface inclined inwardly of the sleeve towards the leading extremity of said push-rod member; and wherein said rib member is provided with a leading end portion bounding said leading end portion of said groove system and inclined inwardly of the sleeve towards said leading extremity, the leading end portion of said rib member having a height less than that of the remainder of said rib member.

4. A push-button unit as defined in claim 1, comprising spring means engaging said latching member to urge said portion thereof against said surface portion of said push-rod member.

5. A push-button unit as defined in claim 1, wherein said latching member is resiliently deformable.

* * * * *